United States Patent [19]

Sugimoto

[11] 4,335,579

[45] Jun. 22, 1982

[54] REFRIGERATING SYSTEM

[75] Inventor: Hitoshi Sugimoto, Nagoya, Japan

[73] Assignee: Aisin Seiki Kabushiki Kaisha, Kariya, Japan

[21] Appl. No.: 187,832

[22] Filed: Sep. 16, 1980

[30] Foreign Application Priority Data

Sep. 17, 1979 [JP] Japan ..... 54-119014

[51] Int. Cl.[3] ..... F25B 9/00

[52] U.S. Cl. ..... 62/6; 62/403

[58] Field of Search ..... 62/6, 403

[56] References Cited

U.S. PATENT DOCUMENTS

| | | | |
|---|---|---|---|
| 2,966,035 | 12/1960 | Gifford | 62/6 |
| 3,138,004 | 6/1964 | Gifford | 62/6 |
| 3,379,026 | 4/1968 | Cowans | 62/6 |
| 3,421,331 | 1/1969 | Webb | 62/6 |
| 3,620,029 | 11/1971 | Longsworth | 62/6 |

FOREIGN PATENT DOCUMENTS

| | | |
|---|---|---|
| 43-17026 | of 1968 | Japan . |
| 44-3933 | of 1969 | Japan . |

*Primary Examiner*—Ronald C. Capossela

*Attorney, Agent, or Firm*—Finnegan, Henderson, Farabow, Garrett & Dunner

[57] ABSTRACT

Refrigerating system including a first refrigerator and a second refrigerator. The second refrigerator comprises a compression piston-cylinder assembly and an expansion piston-cylinder assembly which are connected together through a conduit having a heat radiator and a cold-accummulator to effect a stirling refrigerating cycle. The heat radiator of the second refrigerator is in heat exchange relationship with a cold head of the first refrigerator. A pre-cooling device is provided for transmitting heat from the cylinders of the second refrigerator to the first refrigerator.

12 Claims, 3 Drawing Figures

41
37
30
39
40a
50
38
35
40
28
15
29
16
27
33
35
50
34
31
32
21a
21
19
62

REFRIGERATING SYSTEM

The present invention relates to a refrigerating system and more particularly to a refrigerating system which can efficiently produce a very low temperature.

In order to produce a very low temperature of for example approximately 20° K., there have been proposed several types of refrigerating systems such as those of Claude cycle, Vuilleumier cycle, Solvey cycle, Stirling cycle, Gifford cycle and Gifford-McMaphon cycle. However, these known types of refrigerating systems are not satisfactory from the practical view point. In fact, it has been recognized theoretically and experimentally that these refrigerators are not of a high efficiency in producing a very low temperature lower than 20° K.

It is therefore an object of the present invention to provide a refrigerating system which can produce with a high efficiency a very low temperature as low as or lower than 20° K.

Another object of the present invention is to provide a light, simple, less expensive and reliable refrigerating system.

A further object of the present invention is to provide a refrigerating system which includes a first refrigerating means combined with a refrigerator of Stirling cycle.

According to the present invention, the above and other objects can be accomplished by a refrigerating system comprising first refrigerating means having cooling surface means, second refrigerating means including compression piston-cylinder means, heat radiating means connected with said compressing piston cylinder means and arranged in heat exchange relationship with said cooling surface means in the first refrigerating means and expansion piston-cylinder means connected with said heat radiating means, pre-cooling means for transmitting heat from said piston-cylinder means in said second refrigerating means to said first refrigerating means. The refrigerating cycle in the second refrigerating means is theoretically a stirling cycle comprised of two isothermal processes and two isovolumetric processes and the expansion piston-cylinder means may include piston means which is advanced in phase by approximately 90° than piston means in the compression piston-cylinder means.

The piston means in the compression piston-cylinder means may include buffer means connected with compression chamber means through valve means so that the pressure in the compression chamber means be relieved to the buffer chamber means when excessively high pressure is produced in the compression chamber means and that the pressure in the compression chamber means is automatically regulated. For this purpose, the buffer chamber means may be opened through regulating valve means. In order that the refrigerating gas is precooled in the buffer chamber means, cryo-accumulating means may be provided therein by suitable means such as laminated metallic nets, metal balls, compounds, ceramic materials, plastics and glass clothes so that a suitable temperature gradient is produced therein.

The above and other objects and features of the present invention will become apparent from the following descriptions of preferred embodiments taking reference to the accompanying drawings, in which.

Figure 1:
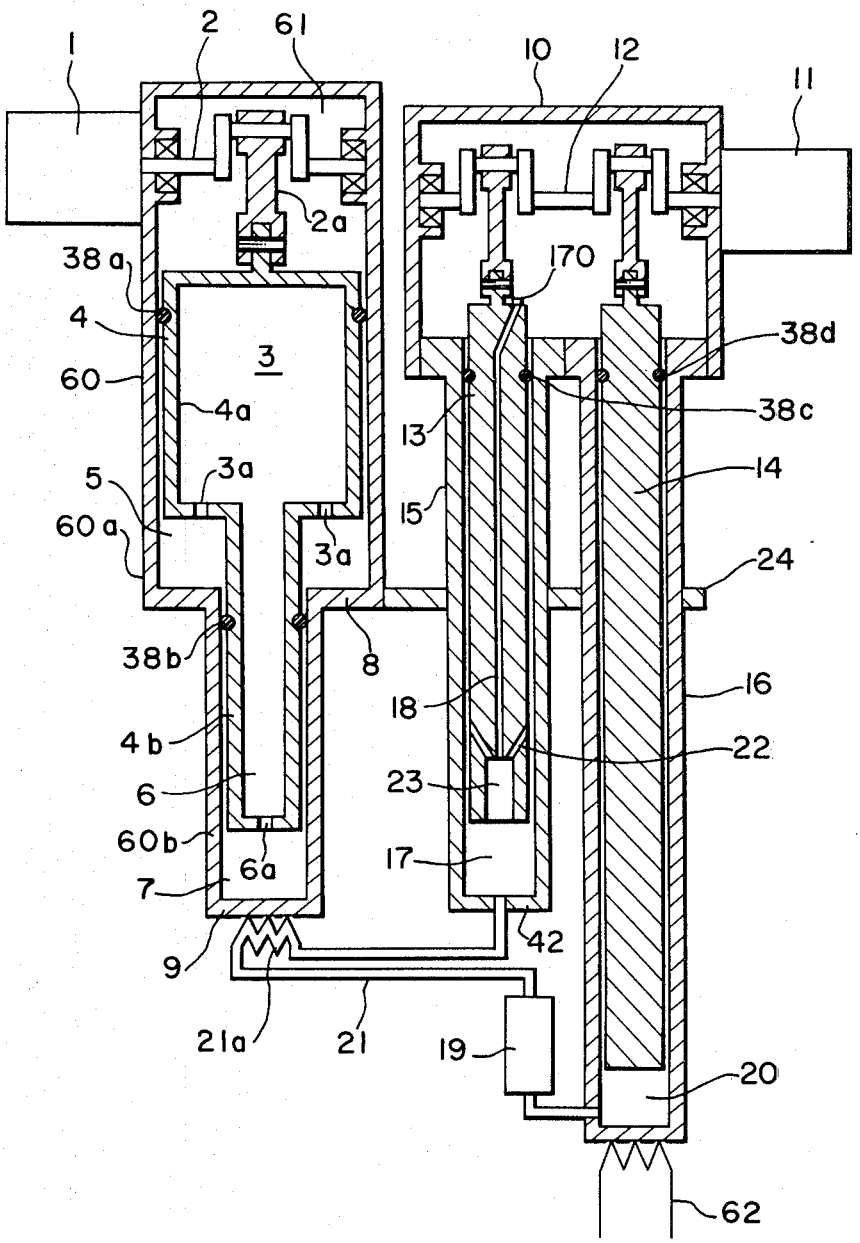
FIG. 1 is a sectional view of the refrigerating system in accordance with one embodiment of the present invention.

Referring now to the drawings, particularly to FIG. 1, there is shown a refrigerating system including a first refrigerator comprising a motor 1 having an output shaft connected with a crankshaft 2 which drives a displacer 4 through a connecting rod 2*a*. The displacer 4 is in the form of a piston disposed in a cylinder 60 for reciprocating movement. The crankshaft 2 and the connecting rod 2*a* are disposed in a crankchamber 61 formed at one end of the cylinder 60. The cylinder 60 has a large diameter portion 60*a* and a small diameter portion 60*b* and the displacer 4 also has a large diameter portion 4*a* and a small diameter portion 4*b* which are respectively fitted in the large diameter portion 60*a* and the small diameter portion 60*b* of the cylinder 60 through sealing rings 38*a* and 38*b*, respectively.

In the large diameter portion 4*a* of the displacer 4, there is a chamber 3 which is connected through a suitable valve mechanism (not shown) with the crankchamber 61 for receiving a supply of pressurized refrigerating gas such as helium gas therefrom. In the chamber 3, there may be provided a suitable cryo-accummulating device for producing a temperature gradient therein. The large diameter portion 4*a* of the displacer 4 defines a first expansion chamber 5 in the large diameter portion 60*a* of the cylinder 60, which is connected with the chamber 3 through openings 3*a*. Similarly, in the small diameter portion 4*b* of the displacer 4, there is defined a chamber 6 in which a suitable cryo-accummulating device is provided for producing a temperature gradient therein. The small diameter portion 4*b* of the displacer 4 defines a second expansion chamber 7 in the small diameter portion 60*b* in the cylinder 60, which is connected with the chamber 6 in the small diameter portion 4*b* of the displacer 4 through an opening 6*a*.

A pressurized refrigerating gas is supplied from a compressor (not shown) to the crankchamber 61 and then through the aforementioned valve mechanism to the chamber 3. A portion of the gas is then discharged through the openings 3*a* to the chamber 5 and the remaining portion of the gas through the chamber 6 and the opening 6*a* to the chamber 7 in an ascending stroke of the displacer 4 to be expanded therein. In the descending stroke of the displacer 4, the gas in the chambers 5 and 7 is displaced through the chambers 3 and 6 to the crankchamber 61 and then to the compressor. In an example, the gas is supplied under a pressure of approximately 20 kg/cm$^2$ and returned to the compressor under a pressure of approximately 7 kg/cm$^2$. Thus, in the cylinder 60, there is defined a first cold head 8 and a second cold head 9. It has been known that this type of refrigerator can produce a temperature of 50° to 100° K. in the first cold head 8 and a temperature of 8° to 12° K. in the second cold head 9. However, it has also been known that the refrigerator is of a poor efficiency in producing a very low temperature lower than 20° K.

According to the illustrated embodiment of the present invention, therefore, there is provided a second refrigerator which includes a crankcase 10 mounted with a motor 11 having an output shaft connected with a crankshaft 12 in the crankcase 10. On the crankcase 10, there are provided a compression cylinder 15 and an expansion cylinder 16 in which a compression piston 13 and an expansion piston 14 are disposed for reciprocating movements. Around the pistons 13 and 14, there are respectively provided sealing rings 38*c* and 38*d*. The pistons 13 and 14 are connected through connecting rods with the crankshaft 12 so that they are driven by the motor 11.

Figure 2:
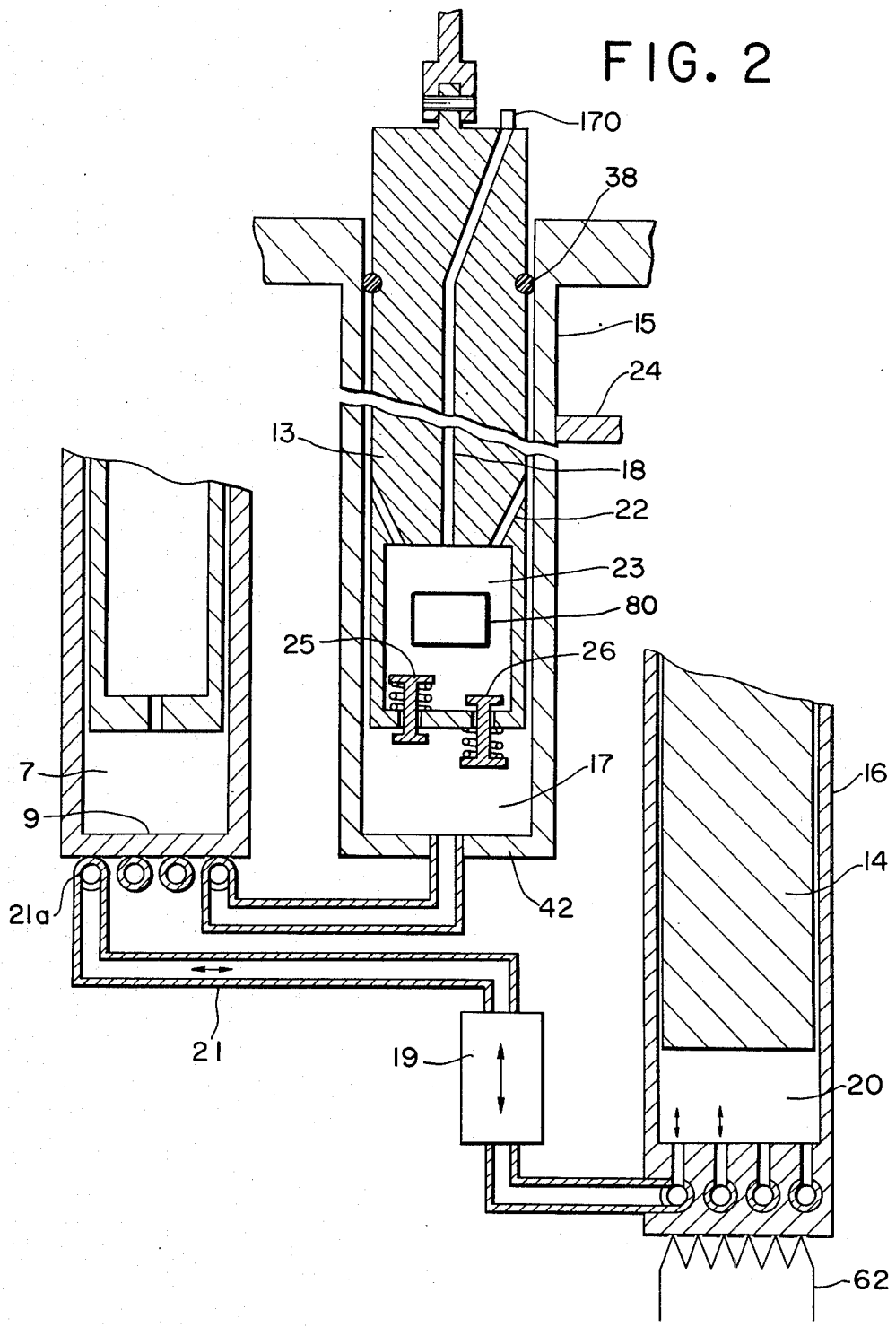
FIG. 2 is a fragmentary sectional view showing details of the system in FIG. 1.

In the compression cylinder 15, there is defined a compression chamber 17 and, in the expansion cylinder 16, there is defined an expansion chamber 20. As shown in FIG. 2, the compression piston 13 is formed at an end adjacent to the compression chamber 17 with a buffer chamber 23 which is connected with the chamber 17 through an outlet valve 25 and an inlet valve 26. In the buffer chamber 23, there may be provided a cryo-accummulating device designated generally as 80. The buffer chamber 23 is opened through a capillary passage 18 and a pressure regulating valve 170 to the crankchamber in the crankcase 10. Further, the buffer chamber 23 is opened through apertures 22 to the side surface of the piston 13.

The compression chamber 17 is connected through a conduit 21 having a cryo-accummulating device 19 with the expansion chamber 20. The conduit 21 is provided with a heat radiator 21*a* which is in a heat-exchange relationship with the cold head 9 in the first refrigerator. A part to be refrigerated is shown in FIGS. 1 and 2 by the reference numeral 62 and is in contact with the end of the expansion cylinder 16 adjacent to the expansion chamber 20. The cylinders 15 and 16 are in heat exchange relationship with a pre-cooling plate 24 which extends from the first cold head 8.

In operation, the pistons 13 and 14 are driven by the motor 11 through the crankshaft 12 with the piston 14 advanced in phase by 90° than the piston 13. The refrigerating gas in the chamber 17 is compressed by the piston 13 and fed through the conduit 21 and the cryo-accummulator 19 to the expansion chamber 20. In the conduit 21, the gas is cooled at the heat radiator 21*a* by the second cold head 9 of the first refrigerator and undergoes an isothermal expansion in the chamber 20 simultaneously cooling the part 62. The gas in the expansion chamber 20 is then displaced therefrom through the cryoaccumulator 19 and the conduit 21 to the compression chamber 17. The operation in the second refrigerator is of a stirling cycle comprised of two isothermal processes and two isovolumetric processes. The pressure in the compression chamber 17 can be regulated by the regulating valve 170 and the buffer chamber 23 is effective to absorb an abrupt change in the pressure of the compression chamber 17. The pre-cooling plate 24 may be made of a heat conductive material such as an aluminum or copper and may be attached with a tube having a suitable gaseous medium such as helium, hydrogen or neon. In an example, the gas as compressed in the chamber 17 may be of a temperature of approximately 15° K. and cooled down at the heat radiator 21*a* to approximately 13° K. The gas is further cooled down at the accummulator 19 and it is possible to produce a temperature of 2° to 5° K. in the expansion chamber 20.

When the second refrigerator is not in operation, the gas in the compression chamber 17 is relieved through the buffer chamber 23 and the passage 18 to the crankchamber in the crankcase 10. Thus, the pressure in the crankchamber is increased in this instance. Practically, the design may be such that the pressure in the crankchamber is changed between 1.5 and 15 kg/cm$^2$.

Figure 3:
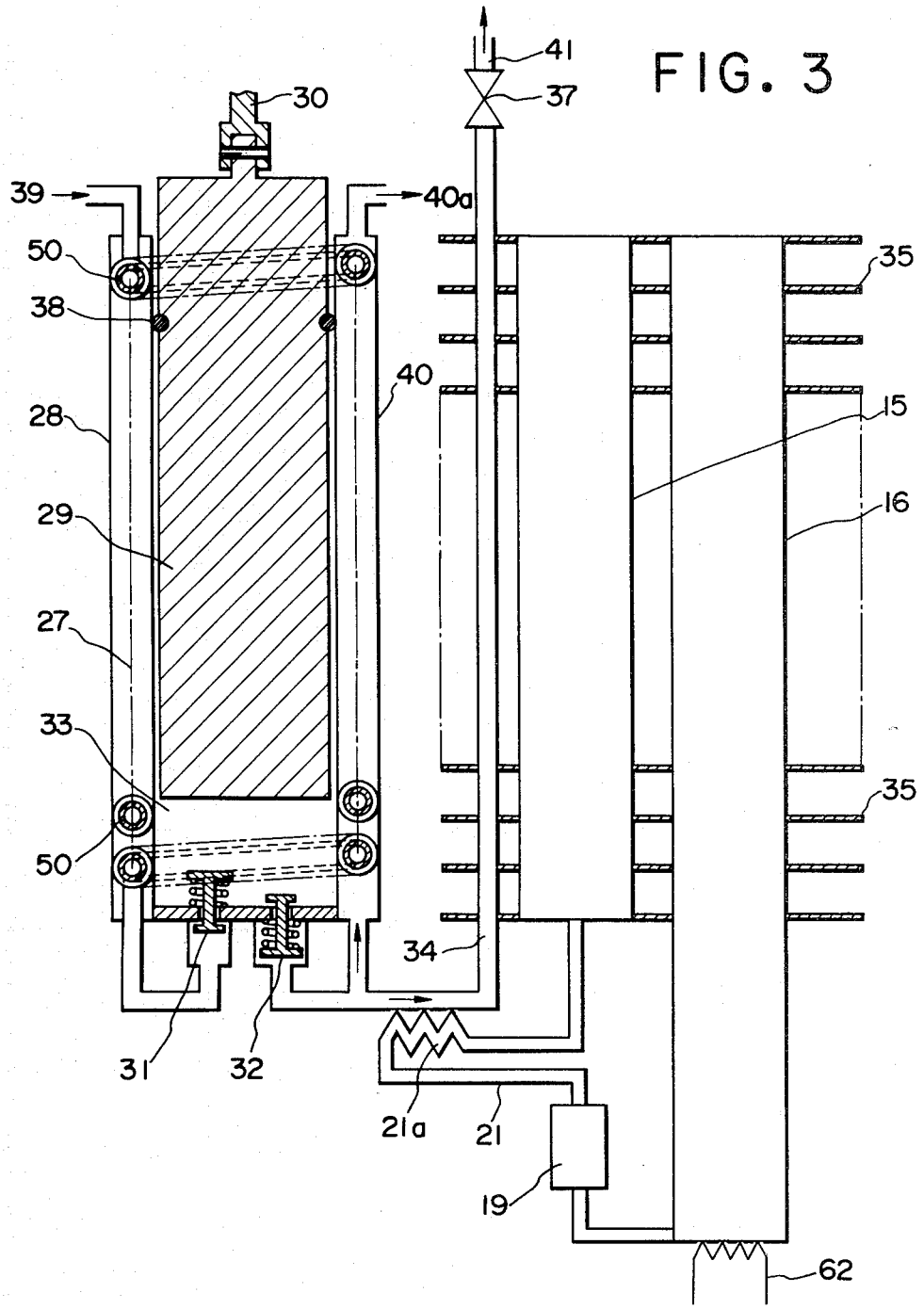
FIG. 3 is a sectional view in accordance with another embodiment of the present invention.

Referring now to FIG. 3, there is shown another embodiment of the present invention which includes a first refrigerator of a type different from that of the embodiment in FIGS. 1 and 2. In this embodiment, the first refrigerator includes an expansion cylinder 28 which is provided with a heat exchanger 27 constituted by a coil of a finned tube 50. In the cylinder 28, there is disposed a piston 29 which is adapted to reciprocate in the cylinder 28. In order to drive the piston 29, a connecting rod 30 is provided. Around the piston 29, there is provided a sealing ring 38 and an expansion chamber 33 is defined in the cylinder 28. The cylinder 28 has an inlet port provided with an inlet valve 31. The tube 50 constituting the heat exchanger 27 has an inlet end 39 where the tube 50 is supplied with a pressurized gas such as helium. The inlet pressure of the gas may for example be 16 kg/cm$^2$. The tube 50 is connected at the other end with the inlet port of the cylinder 28 so that the inlet gas is introduced from a compressor (not shown) through the finned tube 50 of the heat exchanger 27 and the inlet port to the expansion chamber 33. The gas is adiabatically expanded in the chamber 33 to produce a low temperature of for example 8° to 15° K. The pressure of the gas is decreased in the chamber 33 to a pressure of for example 1 to 4 kg/cm$^2$.

The cylinder 28 is formed with an outlet port which has an outlet valve 32 and the outlet port is connected with a passage 40 formed around the finned tube 50 to be returned to the compressor (not shown) through an outlet 40*a* of the passage 40. The outlet port of the cylinder 28 is also connected with a conduit 34 which extends in heat exchange relationship with pre-cooling plates 35 in the second refrigerator which is of a similar construction as that in the previous embodiment. The conduit 34 has an outlet end 41 provided with a flow regulating valve 37. The conduit 21 from the compression cylinder 15 in the second refrigerator has a heat radiator 21*a* which is in heat exchange relationship with the conduit 34. The flow regulating valve 37 may be controlled by a microprocessor (not shown) so that the gas is discharged at outlet end 41 under a normal operating condition to the compressor at an ambient temperature. When it is desired to increase the refrigerating output of the system or to bring the system quickly to the normal operating condition in a starting period, the gas temperature at the outlet end 41 may be adjusted to a lower level so that the gas flow through the valve 37 is increased simultaneously increasing the speed of the piston 29. It is also possible to control the gas flow through the valve 37 and the speed of the driving motors automatically by a computor (not shown) so that the temperature of the part 62 to be cooled is maintained substantially constant. The arrangement of this enbodiment is advantageous in efficiency as compared with the previous embodiment in that the cylinders 15 and 16 in the second refrigerator can be cooled by a plurality of cooling plates 35 with a suitable temperature gradient so that the cooling capacity of the refrigerating gas can be effectively utilized. It is noted that the inlet valve 31 and the outlet valve are actuated by a suitable mechanical or fluid mechanism (not shown) to control the flow rate of the gaseous medium therethrough, respectively.

The invention has thus been shown and described with reference to specific embodiments, however, it should be noted that the invention is in no way limited to the details of the illustrated structures but changes and modifications may be made without departing from the scope of the appended claims.

I claim:

1. A refrigerating system comprising first refrigerating means having cooling surface means, second refrigerating means including compression piston-cylinder means, heat radiating means connected with said compressing piston cylinder means and arranged in heat exchange relationship with said cooling surface means in the first refrigerating means and expansion piston-cylinder means connected with said heat radiating means, pre-cooling means for transmitting heat from said piston-cylinder means in said second refrigerating means to said first refrigerating means.

2. A refrigerating system in accordance with claim 1 in which the compressing piston-cylinder means has compressing piston means and the expansion piston-cylinder means has expansion piston means, said expansion piston means being advanced in phase than the compression piston means by approximately 90°.

3. A refrigerating system in accordance with claim 2 in which said heat radiating means is connected with the expansion piston-cylinder means through means for providing a temperature gradient therebetween.

4. A refrigerating system in accordance with claim 1 in which said first refrigerating means has a first cold head and a second cold head which is of a lower temperature than the first cold head, said cooling surface means being provided by the second cold head, said pre-cooling means being in heat transmitting relationship with said first cold head.

5. A refrigerating system in accordance with claim 1 in which said first refrigerating means includes outlet conduit means for passing a low temperature refrigerating gas, said outlet conduit means providing said cooling surface means and being in heat exchange relationship with said pre-cooling means.

6. A refrigerating system in accordance with claim 5 in which said pre-cooling means includes a plurality of pre-cooling plates arranged in series in lengthwise direction of the compression and expansion piston-cylinder means, said pre-cooling plates being in heat exchange relationship with said outlet conduit means of the first refrigerating means and said compression and expansion piston-cylinder means.

7. A refrigerating system comprising, first refrigerating means having cooling surface means and expansion chamber means, second refrigerating means including compression piston means and expansion piston means housed in respective cylinder means so as to form a compression and expansion chambers therein, respectively, heat radiating means arranged in heat exchange relationship with said cooling surface means and connected with said compression and expansion cylinder means, and pre-cooling means for transmitting heat from said second refrigerating means to said first refrigerating means, said compression piston means of said second refrigerating means being provided at an end adjacent to said compression chamber in the compression cylinder means with cold buffer chamber means which is communicated through valve means to said compression chamber and through capillary passage means formed in said compression piston means with a crankcase positioned to be opposed to said compression chamber.

8. A refrigerating system in accordance with claim 7 in which said first refrigerating means includes expansion cylinder means defining therein said expansion chamber means and having heat exchanger means constituted by a coil of a tube and communicated through said expansion chamber means with said outlet conduit means.

9. A refrigerating system in accordance with claim 8 in which said first refrigerating means includes outlet conduit means for passing a low temperature refrigerating gas, said outlet conduit means providing said cooling surface means and being in heat exchange relationship with said pre-cooling means.

10. A refrigerating system in accordance with claim 7 in which said heat radiating means is connected with said expansion cylinder means through means for providing a temperature gradient therebetween.

11. A refrigerating system in accordance with claim 9 in which said first refrigerating means has a first cold head and a second cold head which is of a lower temperature than the first cold head, said cooling surface means being provided by the second cold head, said pre-cooling means being in heat transmitting relationship with said first cold head.

12. A refrigerating system comprising:

first refrigerating means having cooling surface means and expansion chamber means, second refrigerating means including compression piston means and expansion piston means housed in respective cylinder means so as to form a compression and expansion chambers therein, respectively, heat radiating means arranged in heat exchange relationship with said cooling surface means and connected with said compression and expansion cylinder means, and pre-cooling means for transmitting heat from said second refrigerating means to said first refrigerating means, said compression piston means of said second refrigerating means being provided at an end adjacent to said compression chamber in the compression cylinder means with cold buffer chamber means in which a cryo-accummulating device is provided and which is communicated through capillary passage means to said compression chamber and to a crankcase positioned oppositely to said compression chamber.

* * * * *